US012234537B2

(12) United States Patent
Zhang et al.

(10) Patent No.: US 12,234,537 B2
(45) Date of Patent: Feb. 25, 2025

(54) MEDIUM-CARBON BORON-CONTAINING STEEL AND CONTROLLED ROLLING AND CONTROLLED COOLING METHOD FOR ON-LINE NORMALIZING TREATMENT

(71) Applicant: DAYE SPECIAL STEEL CO., LTD., Hubei (CN)

(72) Inventors: Nian Zhang, Hubei (CN); Wenchao Zheng, Hubei (CN); Xin Ling, Hubei (CN); Ping Chen, Hubei (CN); Guopiao Huang, Hubei (CN); Yingwu He, Hubei (CN)

(73) Assignee: DAYE SPECIAL STEEL CO., LTD., Hubei (CN)

( * ) Notice: Subject to any disclaimer, the term of this patent is extended or adjusted under 35 U.S.C. 154(b) by 0 days.

(21) Appl. No.: 18/560,168

(22) PCT Filed: May 11, 2022

(86) PCT No.: PCT/CN2022/092305
§ 371 (c)(1),
(2) Date: Nov. 10, 2023

(87) PCT Pub. No.: WO2022/207009
PCT Pub. Date: Oct. 6, 2022

(65) Prior Publication Data

US 2024/0240294 A1 Jul. 18, 2024

(30) Foreign Application Priority Data

May 13, 2021 (CN) ..... 202110524496.2

(51) Int. Cl.
*C22C 38/54* (2006.01)
*C21D 1/28* (2006.01)
(Continued)

(52) U.S. Cl.
CPC ..... *C22C 38/54* (2013.01); *C21D 1/28* (2013.01); *C21D 1/84* (2013.01); *C21D 6/005* (2013.01);
(Continued)

(58) Field of Classification Search
None
See application file for complete search history.

(56) References Cited

U.S. PATENT DOCUMENTS

2017/0016081 A1 1/2017 Lee

FOREIGN PATENT DOCUMENTS

CN 101008065 A 8/2007
CN 101045238 A 10/2007
(Continued)

OTHER PUBLICATIONS

International Search Report of the corresponding International Application No. PCT/CN2022/092305, dated Aug. 5, 2022.

*Primary Examiner* — Anthony M Liang
(74) *Attorney, Agent, or Firm* — Global IP Counselors, LLP

(57) ABSTRACT

The present invention provides a medium-carbon boron-containing steel. The chemical components of the medium-carbon boron-containing steel are as follows in mass percentage: 0.37-0.45% of C; 0.17-0.37% of Si; 0.60-0.90% of Mn; 0.020-0.060% of Al; 0.0008-0.0035% of B; 0.030-0.060% of Ti; P≤0.025%; S≤0.025%; Cr≤0.25%; Ni≤0.20%; Mo≤0.10%; Cu≤0.20%; and the remainder is Fe and inevitable impurities. The controlled rolling and controlled cooling method suitable for the on-line normalizing treatment of medium-carbon boron-containing steel sequentially comprises the following steps: heating, rough rolling, finishing rolling, cooling by passing through water, and cold bed slow cooling. The medium-carbon boron-containing steel can
(Continued)

meet the requirements of having a hardness of 190-220 HBW, an actual grain size that is ≥7 grade, and a banded structure that is ≤2 grade.

10 Claims, 3 Drawing Sheets

(51) Int. Cl.

| | |
|---|---|
| ***C21D 1/84*** | (2006.01) |
| ***C21D 6/00*** | (2006.01) |
| ***C21D 9/00*** | (2006.01) |
| ***C22C 38/04*** | (2006.01) |
| ***C22C 38/06*** | (2006.01) |

(52) U.S. Cl.
CPC ..... *C21D 9/0081* (2013.01); *C22C 38/04* (2013.01); *C22C 38/06* (2013.01)

(56) References Cited

FOREIGN PATENT DOCUMENTS

| | | | | | |
|---|---|---|---|---|---|
| CN | 101148737 | A | | 3/2008 | |
| CN | 106350745 | A | | 1/2017 | |
| CN | 109234508 | A | * | 1/2019 | ..... C21D 8/065 |
| CN | 109234627 | A | | 1/2019 | |
| CN | 112090966 | A | | 12/2020 | |
| CN | 113265584 | A | | 8/2021 | |
| FR | 2930609 | A1 | | 10/2009 | |
| JP | 2005-60795 | A | | 3/2005 | |
| WO | 2015/022932 | A1 | | 2/2015 | |

* cited by examiner

MEDIUM-CARBON BORON-CONTAINING STEEL AND CONTROLLED ROLLING AND CONTROLLED COOLING METHOD FOR ON-LINE NORMALIZING TREATMENT

FIELD OF INVENTION

The invention relates to the field of steel rolling, in particular, relates to a medium-carbon boron-containing steel and a method for controlled rolling and controlled cooling for on-line normalizing treatment.

BACKGROUND OF THE INVENTION

A medium carbon boron-containing steel is a kind of structural alloy steel with good hardenability, it is mostly used to manufacture important parts such as automobile constant speed transmission shafts, due to the requirements of processing and use conditions, there are strict requirements for material structure and hardness.

In the manufacturing process, the existing technology generally requires an off-line normalizing treatment for the steel to meet the structural hardenability requirements of the steel, however, because the specification of the finished material used in the production application is small (20-50 mm), it is required to use a professional normalizing furnace to perform the off-line normalizing treatment, which is not only low in production efficiency, but also is prone to have problems of mixing crystals. At the same time, the production cycle of the off-line normalizing treatment performed for the steel is increased by about one week, and the production cost is correspondingly increased by about 400 Yuan/ton, which seriously restricts the mass production and application of this product.

SUMMARY

The purpose of the present invention is to provide a kind of medium-carbon boron-containing steel and a controlled rolling and controlled cooling method for on-line normalizing treatment, the medium-carbon boron-containing steel prepared by this method may significantly refine the hot-rolled structure of the medium-carbon boron-containing steel and meet the requirements of Brinell Hardness of 190-220 HBW, a grain size that is ≥7, and a banded structure that is ≤2, thereby replacing the process of the original off-line normalizing treatment. At the same time, it reduces the production cycle and saves the normalizing cost, thus reducing the production cost of enterprises and improving the product competitiveness.

In order to achieve the above-mentioned object, the present invention provides the following technical solutions:

a medium carbon boron-containing steel, according to the mass percentage, the chemical components of the medium carbon boron-containing steel comprise: C 0.37-0.45%, Si 0.17-0.37%; Mn 0.60-0.90%; Al 0.020-0.060%; B 0.0008-0.0035%; Ti 0.030-0.060%; P≤0.025%; S≤0.025%; Cr≤0.25%; Ni≤0.20%; Mo≤0.10%; Cu≤0.20%; the remainder is Fe and inevitable impurities.

Furthermore, the medium carbon boron-containing steel meets Brinell Hardness of 190-220 HBW, a grain size that is ≥7 grades, and a banded structure that is ≤2 grades.

Furthermore, the specification of the medium carbon boron-containing steel is Φ20-50 mm.

The present invention also provides a controlled rolling and controlled cooling method suitable for the on-line normalizing treatment of the above-mentioned medium carbon boron-containing steel, which sequentially includes the following steps: heating, rough rolling, finish rolling, water cooling, and slow cooling in a cooling bed.

Furthermore, in the above-mentioned controlled rolling and controlled cooling method suitable for the on-line normalizing treatment of the medium carbon boron-containing steel, in the heating step, the heating temperature of the billet steel in the heating furnace is 1100-1200° C., and the total heating time is 90-180 min; preferably, the heating temperature of the billet steel in a heating furnace is 1130-1180° C., and the total heating time is 120-150 min.

Furthermore, in the above-mentioned controlled rolling and controlled cooling method suitable for the on-line normalizing treatment of the medium carbon and boron-containing steel, in the rough rolling step, the inlet temperature of the billet steel entering into the rough rolling mill group is 1000-1050° C.

Furthermore, in the above-mentioned controlled rolling and controlled cooling method suitable for the on-line normalizing treatment of the medium carbon and boron-containing steel, in the finish rolling step, the inlet temperature of the billet steel entering the finish rolling mill group is 780-830° C.; preferably, in the finish rolling step, the inlet temperature of the billet steel entering into the finish rolling mill group is 780-810° C.; preferably, in the finish rolling step, the reducing and sizing finish rolling mill group is adopted for the finish rolling.

Furthermore, in the above-mentioned controlled rolling and controlled cooling method suitable for the on-line normalizing treatment of the medium carbon boron-containing steel, the water cooling refers to water spray cooling through a water tank, and after the water cooling, the water-leaving temperature of the finished steel is 700-750° C.; preferably, the water volume of the water tank is 40-60 L/min, and the traveling speed of the finished steel is 3-8 m/s: preferably, after the water cooling, the water-leaving temperature of the finished steel is 710-730° C.

Furthermore, in the above-mentioned controlled rolling and controlled cooling method suitable for the on-line normalizing treatment of the medium carbon boron-containing steel, in the step of the slow cooling in a cooling bed, the cooling velocity of the finished steel is 0.10-0.15° C./S:

Furthermore, in the above-mentioned controlled rolling and controlled cooling method suitable for the on-line normalizing treatment of the medium carbon boron-containing steel, in the step of the slow cooling in a cooling bed, the finished steel enters a heat preservation cover to be cooled on the cooling bed, and is cooled to below: 500° C. and leaves the heat preservation cover to have air cooling.

Furthermore, in the above-mentioned controlled rolling and controlled cooling method suitable for the on-line normalizing treatment of the medium carbon and boron-containing steel, in step of the slow cooling in a cooling bed, the cooling bed is a step-wise cooling bed.

Furthermore, in the above-mentioned controlled rolling and controlled cooling method suitable for the on-line normalizing treatment of the medium carbon and boron-containing steel, the sectional dimension of the billet steel is 240 mm×240 mm.

Compared with the prior art, the beneficial effects of the present invention are:

(1) there is no need to adjust the steel components again during the production process, and there is no need to add additional off-line normalizing production equipment, by only adjusting the rolling forming and the cooling process, the on-line normalizing treatment of such products can be realized, and can meet the structural hardenability requirements of the steel at the same time;

(2) the temperature control range is wide in each stage of the production process, and the industrial production is easy to control and realize;

(3) the use of on-line normalizing in the heating step instead of off-line normalizing is to reduce the investment in fixed equipment, shorten the production cycle (about 1 week), reduce the production cost (about 400 Yuan/ton), speed up the production cycle, reduce the production cost, and improve the product competitiveness.

(4) the use of the medium carbon boron-containing steel manufactured by this method can meet the requirements of hardness of 190-220 HBW, an actual grain size that is ≥7, and a banded structure that is ≤2, and fully meet the technical specification requirements of a user for this product after off-line normalizing.

BRIEF DESCRIPTION OF THE DRAWINGS

The specific examples of the present utility model will be further clarified below in combination with the attached drawings. It should be noted that the attached drawings of the description, which constitute a part of the present application, are used to provide a further understanding for the present invention, the schematic embodiments of the present invention and their description are used for interpreting the present invention, and do not constitute an inappropriate definition of the present invention. Wherein.

DETAILED DESCRIPTION OF THE EMBODIMENTS

Figure 1:
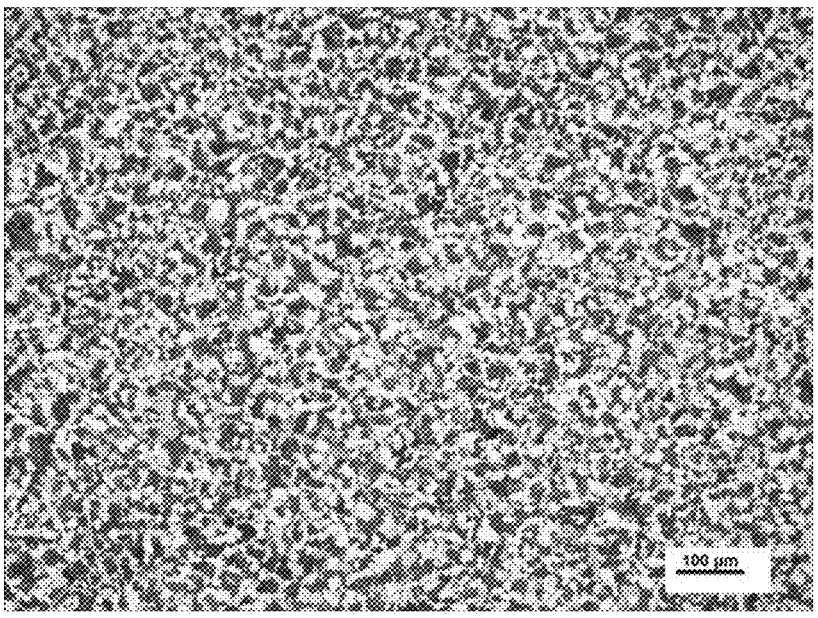
FIG. 1 is a microstructure diagram at ½ radius of 40B steel with a specification of 32 mm produced in embodiment 1.

The present invention will be described in detail below with reference to the attached drawings and in conjunction with the embodiments. Various examples are provided by way of interpreting the invention rather than limiting the invention. In fact, it should be clear to those skilled in the art that modifications and variations could be made in the present invention without departing from the scope or spirit of the invention. For example, features illustrated or described as a part of one embodiment may be used in another embodiment, so as to yield yet another embodiment. Therefore, it is intended that the present invention embraces such modifications and variations included within the scope of the appended claims and their equivalents.

One or more embodiments of the invention are shown in the accompanying drawings. The detailed description uses numerical and letter designations to refer to features in the drawings. Similar or alike markings in the drawings and descriptions have been used to refer to similar or alike parts of the present invention.

Figure 2:
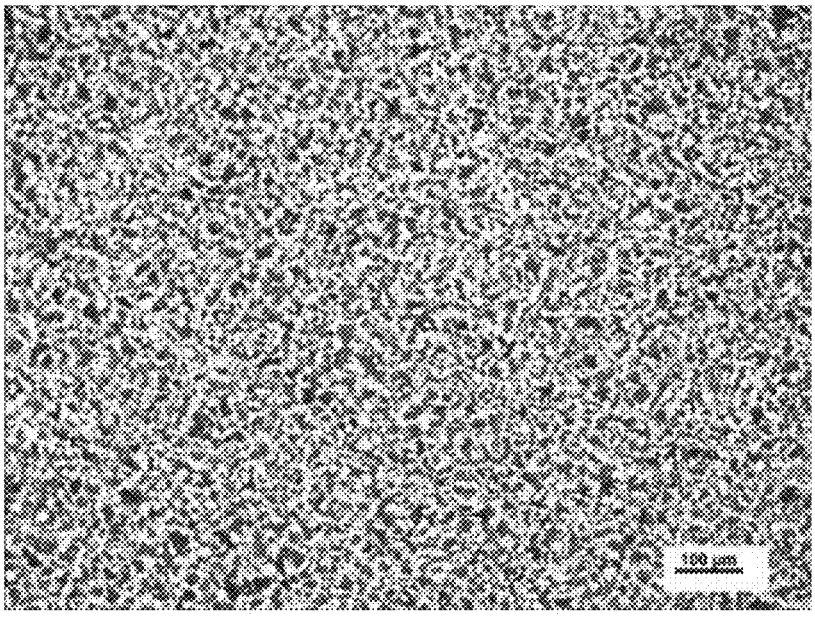
FIG. 2 is a microstructure diagram at ½ radius of 40B steel with a specification of 28 mm produced in embodiment 2.

As shown in FIG. 1 and FIG. 2, according to an embodiment of the present invention, a kind of medium carbon boron-containing steel is provided, according to the mass percentage, the chemical components of the medium carbon boron-containing steel comprise:

C 0.37-0.45%, Si 0.17-0.37%; Mn 0.60-0.90%; Al 0.020-0.060%; B 0.0008-0.0035%; Ti 0.030-0.060%; P≤0.025%; S≤0.025%; Cr≤0.25%; Ni≤0.20%; Mo≤0.10%; Cu≤0.20%; the remainder is Fe and inevitable impurities: the medium carbon boron-containing steel mainly uses manganese Mn and boron B as alloying elements, if the contents of alloying elements such as chromium Cr, nickel Ni, molybdenum Mo or copper Cu are too high, it is easy to form bainite and other structures after the controlled rolling and controlled cooling, resulting in over hardness.

The specification of the medium carbon boron-containing steel is Φ20-50 mm; the medium carbon boron-containing steel meets Brinell Hardness of 190-220 HBW, an actual grain size that is ≥7, and a banded structure that is ≤2, the specification of the medium carbon boron-containing steel is Φ20-50 mm.

According to an embodiment of the present invention, a controlled rolling and controlled cooling method suitable for the on-line normalizing treatment of the medium-carbon boron-containing steel is provided, which sequentially comprises the following steps: heating, rough rolling, finish rolling, water cooling, and slow cooling in a cold bed, wherein, a billet steel with a sectional dimension of 240 mm×240 mm is selected.

In the heating step, the heating temperature of the billet steel in the heating furnace is 1100-1200° C., (such as 1100° C., 1110° C., 1120° C., 1130° C., 1140° C., 1150° C., 1160° C., 1170° C., 1180° C., 1190° C., 1200° C. and an interval range or an interval point between any two temperatures), and the total heating time is 90-180 min, (such as 90 min, 100 min, 110 min, 120 min, 130 min, 140 min, 150 min, 160 min, 170 min, 180 min and a time point between any two time periods).

As a preferred embodiment, in the heating step, the heating temperature of the billet steel in the heating furnace is 1130-1180° C. (such as 1130° C., 1140° C., 1150° C., 1160° C., 1170° C., 1180° C. and an interval range or an interval point between any two temperatures), the total heating time is 120-150 min (such as 120 min, 130 min, 140 min, 150 min and a time point between any two time periods): the purpose of selecting the corresponding heating temperature and heating time is to ensure that the billet steel is fully heated and overheating is not occurred.

In the rough rolling step, wherein, when entering into the rough rolling mill group, the inlet temperature is 1000-1050° C. (such as 1000° C., 1010° C., 1020° C., 1030° C., 1040° C., 1050° C. and an interval range or an interval point between any two temperatures). The rough rolling mill group is a 6 horizontal and vertical continuous rolling mill group, and the diameter of the work roll is 650 mm. The inlet temperature of the rough rolling mill group is related to the temperature in the heating step, the temperature of the billet steel would decrease due to dephosphorization by high-pressure water between the heating step and the rough rolling step.

In the finish rolling step, the finish rolling mill group adopts a reducing and sizing finish rolling mill group, and when entering into the finish rolling mill group, the inlet temperature is 780-830° C. (such as 780° C., 790° C., 800° C., 810° C., 820° C., 830° C. and an interval range or an interval point between any two temperatures), a more preferred inlet temperature when entering into the finish rolling mill group is 780-810° C. (such as 780° C., 790° C., 800° C., 810° C. and an interval range or an interval point between any two temperatures). The finish rolling mill group is a 4-set of three-roll reducing and sizing finish rolling mill, the use of a three-roll reducing and sizing finish rolling mill makes the deformation amount of the finished product large, which is conducive to refine grains.

In the water cooling step, the water-leaving temperature of the finished steel after the water cooling is 700-750° C. (such as 700° C., 710° C., 720° C., 730° C., 740° C., 750° C. and an interval range or an interval point between any two temperatures): a more preferred the water-leaving temperature of the finished steel after the water cooling is 710-730° C. (such as 710° C., 720° C., 730° C. and an interval range or an interval point between any two temperatures). The water volume of the water tank is 40-60 L/min, and preferably, the traveling speed of the finished steel is 3-8 m/s (which can be selected according to the specification of the finished product). The water cooling and the above parameter settings can prevent the steel from temperature building-up and from the occurrence of recovering and recrystallization during the rolling process, resulting in coarse grains.

In the step of the slow cooling in a cooling bed, the finished steel enters into the cooling bed and is performed with the slow cooling after the water cooling step, the cooling bed employs a step-wise cooling bed to perform the slow cooling, the cooling velocity of the finished steel is 0.10-0.15° C./S: the finished steel enters into a heat preservation cover to be cooled on the cooling bed and is cooled to below 500° C., and the finished steel is removed from the heat preservation cover to have air cooling again. The use of a heat preservation cover for air cooling has a slow cooling effect, so as to prevent the finished steel from the occurrence of deformation during subsequent turning or heat treatment due to high internal residual stress from fast cooling. If the finished steel is air-cooled directly, the internal stress of the steel may be caused to be large, and the problem of deformation will arise in the subsequent processing. If the finished steel enters into the heat preservation cover and is cooled on a cooling bed, the problem caused by the direct air-cooling can be avoided.

The medium carbon boron-containing steel produced by the method disclosed in this application can meet the requirements of Brinell Hardness of 190-220 HBW, a grain size that is ≥7, and a banded structure that is ≤2 without the off-line normalizing process, and can fully meet the technical specification requirements of a user for this product after the off-line normalizing. The controlled rolling and controlled cooling method for the medium-carbon boron-containing steel saves the cost and time of the off-line normalizing step, reduces the investment in fixed equipment, shortens the production cycle, reduces the production cost, accelerates the production cycle and improves the product competitiveness.

Embodiment 1

The sectional dimension of the selected billet steel is 240 mm×240 mm; according to the mass percentage, the chemical components of the billet steel of the medium carbon boron-containing steel comprise: C 0.38%; Si 0.25%; Mn 0.86%; Al 0.032%; B 0.0017%; Ti 0.047%; P 0.013%; S 0.005%; Cr 0.14%; Ni 0.03%; Mo 0.02%; Cu 0.02%; the remainder is Fe and inevitable impurities: the sectional dimension of the billet steel is 240 mm×240 mm.

Heating step: when entering into the heating furnace, the heating temperature of the billet steel is 1140-1160° C., and the total heating time is 142 min:

- rough rolling step: when entering into the rough rolling mill group, the inlet temperature is 1038° C.;
- finishing rolling step: a reducing and sizing finish rolling mill group is used, and when entering into the finish rolling mill group, the inlet temperature is 795° C.;
- water cooling step: the finished steel rolled by the reducing and sizing finish rolling mill group is sprayed and cooled by the water tank after being cut off by a flying shear, the water-leaving temperature of the finished steel after the water cooling is 728° C.;
- the step of slow cooling in a cooling bed: it is carried out in a step-wise cooling bed, and the cooling velocity of the finished steel is 0.10-0.15° C./S;
- the finished steel after being cutting off is cooled by a step-wise cooling bed with a heat preservation cover, the heat preservation cover is closed to make the finished steel cool slowly on the cooling bed, it is cooled to 475° C. and is removed from the heat preservation cover to have air cooling again.

The hardness at ½ of the section of the finished steel after being processed by the above steps is 204/208 HBW; the actual grain size is grade 8; as shown in FIG. 1, the banded structure is grade 1.5.

Embodiment 2

According to the mass percentage, the chemical components of the billet steel of the medium carbon boron-containing steel comprise: C 0.38%; Si 0.25%; Mn 0.84%; Al 0.028%; B 0.0020%; Ti 0.045%; P 0.012%; S 0.008%; Cr 0.12%; Ni 0.02%; Mo 0.03%; Cu 0.03%; the remainder is Fe and inevitable impurities: the sectional dimension of the selected billet steel is 240 mm×240 mm.

The steps of the controlled rolling and controlled cooling method suitable for the on-line normalizing treatment of the medium carbon boron-containing steel are as in Embodiment 1, wherein, see Table 1 for the parameters of each step of the controlled rolling and controlled cooling method suitable for the on-line normalizing treatment of the medium carbon and boron-containing steel. The hardness at ½ of the section of the finished steel after being processed by the steps of the Embodiment 2 is 212/215 HBW: the actual grain size is grade 9; as shown in FIG. 2, the banded structure is grade 1.5.

| | Embodiment 1 | Embodiment 2 |
|---|---|---|
| Billet steel size (mm) | 240*240 | 240*240 |
| Heating temperature (° C.) | 1140-1160 | 1145-1163 |
| Total heating time (min) | 142 | 135 |
| Temperature upon entering into the rough rolling mill (° C.) | 1038 | 1025 |
| Temperature upon entering into the finish rolling mill (° C.) | 795 | 802 |

-continued

| | Embodiment 1 | Embodiment 2 |
|---|---|---|
| Temperature upon leaving the water tank (° C.) | 728 | 715 |
| Cooling velocity of the cooling bed (° C./S) | 0.125 | 0.132 |
| Temperature upon leaving the heat preservation cover (° C.) | 475 | 462 |
| Hardness at ½R (HBW) | 204/208 | 212/215 |
| Grain size (grade) | 8 | 9 |
| Banded structure (grade) | 1.5 | 1.5 |

Embodiments 3-5

The chemical components of the medium carbon boron-containing steel billets in Embodiments 3-5 are the same as those of Embodiment 1.

In Embodiments 3-5, the parameters of each step of heating, rough rolling, finish rolling, water cooling, and slow cooling in a cooling bed are shown in Table 2, the performance of the finished steel includes hardness at ½R, the grades of the grain size and the banded structure are also shown in Table 2.

| | Embodiment 3 | Embodiment 4 | Embodiment 5 |
|---|---|---|---|
| Billet steel size (mm) | 240*240 | 240*240 | 240*240 |
| Heating temperature (° C.) | 1140-1150 | 1140-1155 | 1135-1150 |
| Total heating time (min) | 145 | 138 | 145 |
| Temperature upon entering into the rough rolling mill (° C.) | 1028 | 1033 | 1045 |
| Temperature upon entering into the finish rolling mill (° C.) | 785 | 798 | 805 |
| Temperature upon leaving the water tank (° C.) | 725 | 729 | 735 |
| Cooling velocity of the cooling bed (° C./S) | 0.124 | 0.130 | 0.132 |
| Temperature upon leaving the heat preservation cover (° C.) | 473 | 465 | 468 |
| Hardness at ½R (HBW) | 202/203 | 210/208 | 212/214 |
| Grain size (grade) | 8 | 8.5 | 8 |
| Banded structure (grade) | 2.0 | 1.5 | 1.5 |

It can be seen from Table 2, the hardness at ½R of the steel obtained in Embodiments 3-5 is 202-214 HBW, the grain size is grade 8-8.5 and the banded structure is grade 1.5-2.0.

Embodiments 6-8

The chemical components of the medium carbon boron-containing steel billets in Embodiments 3-5 are the same as those of Embodiment 1.

In Embodiments 6-8, the parameters of each step of heating, rough rolling, finish rolling, water cooling, and slow cooling in a cooling bed are shown in Table 3, the performance of the finished steel includes hardness at ½R, the grades of the grain size and the banded structure are also shown in Table 3.

| | Embodiment 6 | Embodiment 7 | Embodiment 8 |
|---|---|---|---|
| Billet steel size (mm) | 240*240 | 240*240 | 240*240 |
| Heating temperature (° C.) | 1138-1150 | 1145-1160 | 1143-1162 |
| Total heating time (min) | 140 | 128 | 147 |
| Temperature upon entering into the rough rolling mill (° C.) | 1025 | 1042 | 1045 |
| Temperature upon entering into the finish rolling mill (° C.) | 796 | 802 | 808 |
| Temperature upon leaving the water tank (° C.) | 730 | 722 | 728 |
| Cooling velocity of the cooling bed (° C./S) | 0.128 | 0.129 | 0.132 |
| Temperature upon leaving the heat preservation cover (° C.) | 470 | 460 | 462 |
| Hardness at ½R (HBW) | 204/207 | 205/209 | 215/218 |
| Grain size (grade) | 9 | 8 | 8 |
| Banded structure (grade) | 1.5 | 2.0 | 2.0 |

It can be seen from Table 3, the hardness at ½R of the steel obtained in Embodiments 6-8 is 204-218 HBW, the grain size is grade 8-9 and the banded structure is grade 1.5-2.0.

Comparative Embodiments 1-3

The chemical components of the medium carbon boron-containing steel billets in Comparative Embodiments 1-3 are the same as those of Embodiment 1.

In Comparative Embodiments 1-3, the parameters of each step of heating, rough rolling, finish rolling, water cooling, and slow cooling in a cooling bed are shown in Table 4.

| | Comparative embodiment 1 | Comparative embodiment 2 | Comparative embodiment 3 |
|---|---|---|---|
| Billet steel size (mm) | 240*240 | 240*240 | 240*240 |
| Heating temperature (° C.) | 1250-1300 | 1150-1165 | 1142-1158 |
| Total heating time (min) | 145 | 300 | 143 |
| Temperature upon entering into the rough rolling mill (° C.) | 1130 | 1035 | 1028 |
| Temperature upon entering into the finish rolling mill (° C.) | 825 | 815 | 783 |
| Temperature upon leaving the water tank (° C.) | 745 | 728 | 721 |
| Cooling velocity of the cooling bed (° C./S) | 0.143 | 0.125 | 0.208 |
| Temperature upon leaving the heat preservation cover (° C.) | 455 | 478 | None |
| Hardness at ½R (HBW) | 228/226 | 205/208 | 238/240 |
| Grain size (grade) | 8-5 | 8-5 | 8 |
| Banded structure (grade) | 1.5 | 2.0 | 2.0 |

Figure 3:
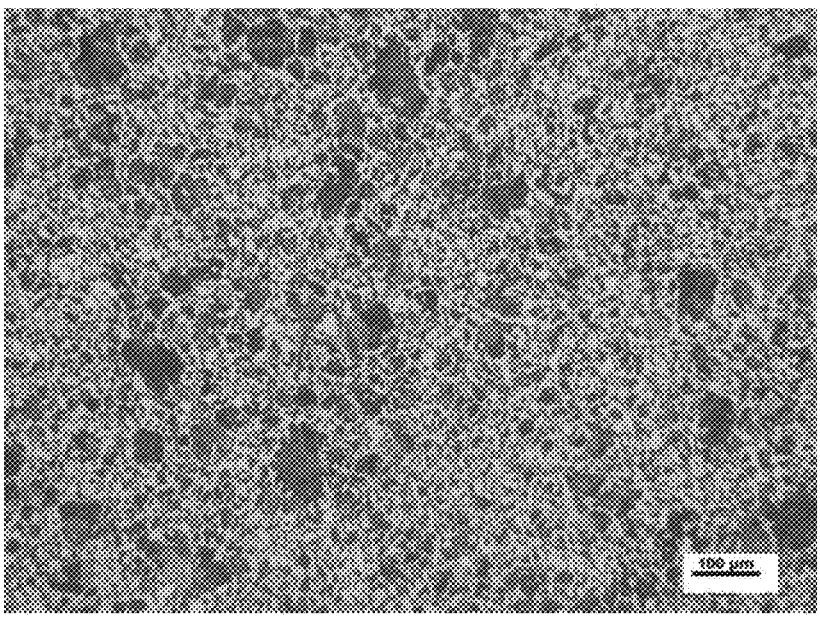
FIG. 3 is a microstructure diagram at ½ radius of 40B steel with a specification of 30 mm produced in a comparative embodiment 1.

It can be seen from Table 4, wherein, in Comparative embodiment 1, except the difference of the heating temperature in the heating step causes the temperature upon entering into the rough rolling mill to be too high, the process parameters of other steps are all within the protection scope of the present application. Due to the heating temperature in the heating step being excessively high, as shown in FIG. 3, the original austenite grain size of the raw materials is caused to be coarse, the amount of cooling water in the rolling process increase, the grain size be coarse partially and the hardness be high after being finished.

Figure 4:
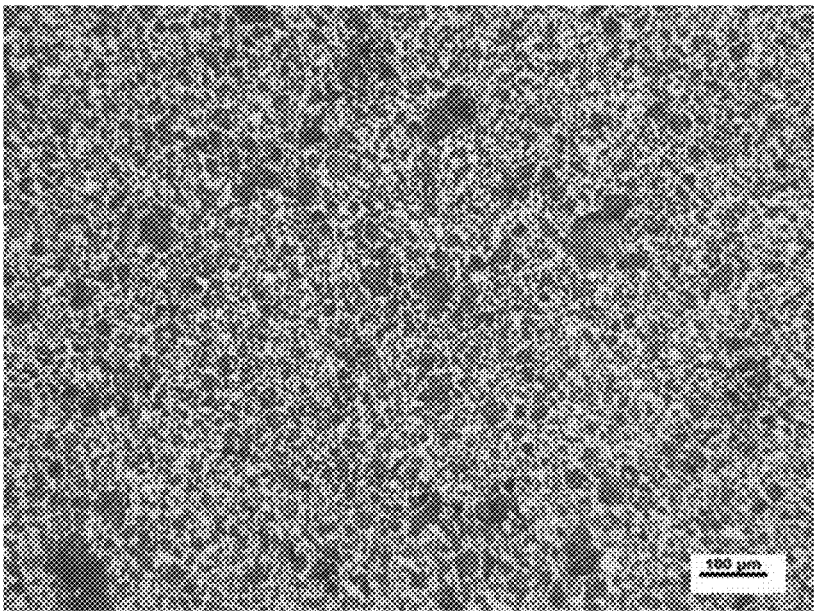
FIG. 4 is a microstructure diagram at ½ radius of 40B steel with a specification of 34 mm produced in a comparative embodiment 2.

In Comparative embodiment 2, except the difference of the total heating time in the heating step, the process parameters of other steps are all within the protection scope of the present application. Due to the heating time being excessively long, as shown in FIG. 4, the original austenite grain size of the raw materials is caused to be coarse, the grain size be coarse partially after being finished.

Figure 5:
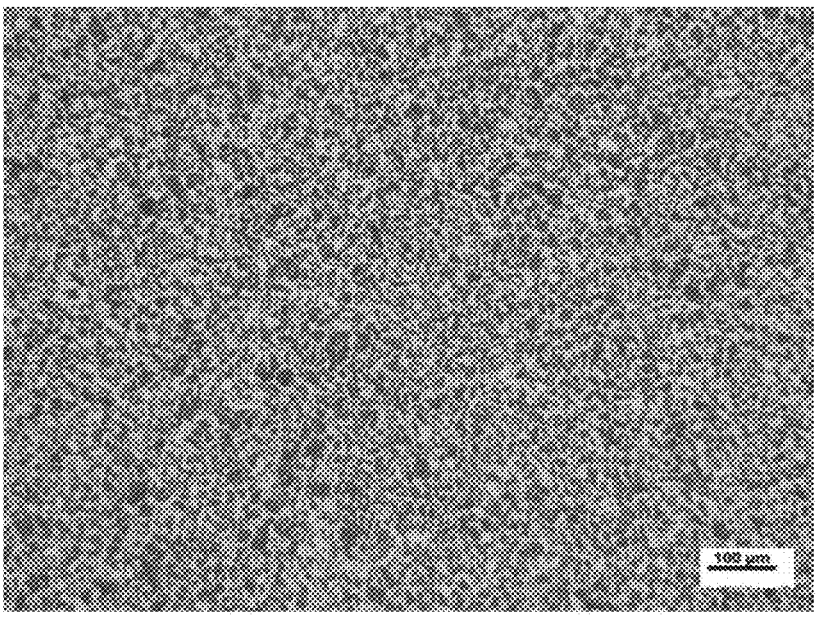
FIG. 5 is a microstructure diagram at ½ radius of 40B steel with a specification of 28 mm produced in a comparative embodiment 3.

In Comparative embodiment 3, except the direct entrance of a cooling bed for cooling without the heat preservation cover in the step of the slow cooling in a cooling bed, the process parameters of other steps are all within the protection scope of the present application. Because the cooling velocity is too fast without the heat preservation cover, as shown in FIG. 5, the hardness of the raw material is caused to be high, the residual internal stress be large, and the risk of subsequent processing and deformation arise.

Combined with the analysis in Embodiments 1-8 and Comparative embodiments 1-3, the present invention provides a controlled rolling and controlled cooling method suitable for the on-line normalizing treatment of the medium carbon boron-containing steels, the on-line normalizing treatment is made by adjusting the temperature and the cooling velocity of the steel in the rolling and makes the hardness and the structure of the hot-rolled steel meet the requirements of the original normalizing state.

The above descriptions are only preferred embodiments of the present invention, and are not used to limit the present invention, for those skilled in the art, the present invention may have various modifications and changes. Any modification, equivalent substitution, improvement, etc. made within the spirit and principle of the present invention, should be included within the protection scope of the present invention.

What is claimed is:

1. A controlled rolling and controlled cooling method suitable for an on-line normalizing treatment of a medium-carbon boron-containing steel, which is characterized in that, according to mass percentage, the chemical components of the medium carbon boron-containing steel comprise:

C 0.37-0.45%, Si 0.17-0.37%; Mn 0.60-0.90%; Al 0.020-0.060%; B 0.0008-0.0035%; Ti 0.030-0.060%; P≤0.025%; S≤0.025%; Cr≤0.25%; Ni≤0.20%; Mo≤0.10%; Cus 0.20%; the remainder is Fe and inevitable impurities;

the controlled rolling and controlled cooling method characterized in that, the controlled rolling and controlled cooling method sequentially includes the following steps: heating, rough rolling, finish rolling, water cooling, and slow cooling in a cooling bed;

in the heating step, a billet steel is heated in a heating furnace at a heating temperature of 1100-1200° C. for a total heating time of 90-180 min;

in the rough rolling step, the billet steel enters into a rough rolling mill group at an inlet temperature of 1000-1050° C.;

in the finish rolling step, the billet steel enters a finish rolling mill group at an inlet temperature of 780-830° C.;

the water cooling refers to water spray cooling through a water tank, and after the water cooling, a finished steel leaves at a water-leaving temperature of 700-750° C.;

the water is supplied by the water tank at a volume flow rate of 40-60 L/min, the finished steel travels at a traveling speed of 3-8 m/s;

in the step of the slow cooling in a cooling bed, of the finished steel is cooled at a cooling velocity of 0.10-0.15° C./s;

in the step of the slow cooling in a cooling bed, the finished steel enters into a heat preservation cover so as to be cooled on the cooling bed, and is cooled to below 500° C. and leaves the heat preservation cover to have air cooling.

2. The controlled rolling and controlled cooling method suitable for the on-line normalizing treatment of the medium-carbon boron-containing steel according to claim 1, which is characterized in that, in the finish rolling step, the inlet temperature of the billet steel entering into the finish rolling mill group is 780-810° C.;

in the finish rolling step, a reducing and sizing finish rolling mill group is adopted for the finish rolling.

3. The controlled rolling and controlled cooling method suitable for the on-line normalizing treatment of the medium-carbon boron-containing steel according to claim 1, which is characterized in that, after the water cooling, the water-leaving temperature of the finished steel is 710-730° C.

4. The controlled rolling and controlled cooling method suitable for the on-line normalizing treatment of the medium-carbon boron-containing steel according to claim 1, which is characterized in that, in the step of the slow cooling in a cooling bed, the cooling bed is a step-wise cooling bed.

5. The controlled rolling and controlled cooling method suitable for the on-line normalizing treatment of the medium-carbon boron-containing steel according to claim 1, which is characterized in that, the billet steel has a sectional dimension of 240 mm×240 mm.

6. The controlled rolling and controlled cooling method suitable for the on-line normalizing treatment of the medium-carbon boron-containing steel according to claim 1, which is characterized in that, the medium-carbon boron-containing steel meets Brinell Hardness of 190-220HBW, a grain size that is ≥7, and a banded structure that is ≤2, the medium carbon boron-containing steel has a specification of Φ20-50 mm.

7. The controlled rolling and controlled cooling method suitable for the on-line normalizing treatment of the medium-carbon boron-containing steel according to claim 6, which is characterized in that, in the finish rolling step, the inlet temperature of the billet steel entering into the finish rolling mill group is 780-810° C.;

in the finish rolling step, a reducing and sizing finish rolling mill group is adopted for the finish rolling.

8. The controlled rolling and controlled cooling method suitable for the on-line normalizing treatment of the medium-carbon boron-containing steel according to claim 6, which is characterized in that, after the water cooling, the water-leaving temperature of the finished steel is 710-730° C.

9. The controlled rolling and controlled cooling method suitable for the on-line normalizing treatment of the medium-carbon boron-containing steel according to claim 6, which is characterized in that, in the step of the slow cooling in a cooling bed, the cooling bed is a step-wise cooling bed.

10. The controlled rolling and controlled cooling method suitable for the on-line normalizing treatment of the medium-carbon boron-containing steel according to claim 6, which is characterized in that, the billet steel has a sectional dimension of 240 mm×240 mm.

* * * * *